US006125542A

United States Patent [19]

Somma

[11] Patent Number: 6,125,542

[45] Date of Patent: Oct. 3, 2000

[54] SELF-POWERED RAZOR HEAD

[76] Inventor: Dante Somma, 41 Juniper Rd., Andover, Mass. 01810

[21] Appl. No.: 09/070,545

[22] Filed: Apr. 30, 1998

[51] Int. Cl.[7] ..... B26B 19/30

[52] U.S. Cl. ..... 30/46; 30/42

[58] Field of Search ..... 30/34.05, 42, 44, 30/46, 50, 34.2

[56] References Cited

U.S. PATENT DOCUMENTS

| | | | |
|---|---|---|---|
| 1,158,914 | 11/1915 | Gaisman . | |
| 1,361,266 | 12/1920 | La Chance et al. . | |
| 1,368,693 | 2/1921 | Browning | 30/46 |
| 2,066,215 | 12/1936 | Mignon | 30/46 |
| 2,089,415 | 8/1937 | Parkin | 30/46 |
| 2,137,327 | 11/1938 | Berty | 30/46 |
| 2,355,830 | 8/1944 | Van Slyke | 30/46 |
| 2,532,714 | 12/1950 | Griffin | 30/46 |
| 3,481,035 | 12/1969 | Anderson . | |
| 3,636,627 | 1/1972 | Tiffin . | |
| 5,131,147 | 7/1992 | Plevyak et al. . | |
| 5,299,354 | 4/1994 | Metcalf et al. . | |
| 5,347,714 | 9/1994 | Prochaska . | |

FOREIGN PATENT DOCUMENTS

| | | | |
|---|---|---|---|
| 474824 | 2/1936 | United Kingdom | 30/46 |

*Primary Examiner*—Hwei-Siu Payer
*Attorney, Agent, or Firm*—O'Connell Law Firm

[57] ABSTRACT

A self-powered razor head for shaving hair from a skin surface with at least one reciprocating blade with a roller with an annular skin engaging surface rotatably supported by a support case. In one embodiment, a first razor shuttle has first and second drive arms extending therefrom to travel oppositely in phase against a plurality of ridges and troughs of the roller to induce a reciprocation of the first razor shuttle and a first razor blade that is attached thereto in response to a rotation of the roller. A reciprocation of a second razor shuttle is generated by a pivoting drive lever that has a first end pivotally coupled to the first razor shuttle, a second end pivotally coupled to the second razor shuttle, and a fulcrum point therebetween. Instead of the second drive arm and the ridges and troughs against which it is disposed, the first drive arm may be biased to travel against the plurality of ridges and troughs of the first end of the roller by a resilient biasing member. The ends of the drive lever may be pivotally coupled by a frictional coupling, by restrictive shoulders, or by a unitary formation of that end of the drive lever and a razor shuttle.

18 Claims, 2 Drawing Sheets

SELF-POWERED RAZOR HEAD

FIELD OF THE INVENTION

The present invention relates generally to shaving devices. More particularly, the invention disclosed herein is directed to a self-powered razor head with at least one reciprocating blade for shaving hair from a skin surface.

BACKGROUND OF THE INVENTION

The prior art reveals shaving devices of diverse structure and function, One line of technological development most basically comprises a razor head with a single razor blade mounted within a support case that is supported by a handle. In certain embodiments, the razor head and the handle are pivotally coupled with the purported advantage of improving shaving performance. Other shavers form the razor head and the handle as an integral unit. Such prior art devices shave hair from a skin surface by a shearing action of the razor blade as the razor head is brought into contact with a hair shaft through a raking motion produced by the user as the razor head is drawn across the skin surface that is to be shaved. Improved shaving devices include razor heads with two razor blades that are said to provide improved shearing action through a cooperation between the two razor blades as the blades are raked over a skin surface.

A multiplicity of inventors have set about providing improvements to these most basic shaving devices. Among the goals of these improvements has been to improve the overall comfort provided to the user while shaving. For example, shavers with self-contained shaving cream cartridges have been disclosed wherein the internally contained shaving cream supplies the skin surface and the hair that is to be shaved with a lubricant. Other inventors have revealed shaving devices wherein an oscillating vibration is imparted to the razor head with the stated purpose of desensitizing a user's facial nerves against the discomfort commonly associated with shaving.

Advantageously, still further devices are found in the art that include reciprocating razor heads. With such shaving devices, the razor blade or blades of the razor head shave hair from a user's face not only with the shearing action exercised by traditional razor heads but also with a slicing action resulting from the lateral reciprocation of the razor blade or blades. These devices normally contemplate a power source such as batteries or another source of electric power. One may note that it has been supposed that such shaving devices with reciprocating razor heads can achieve a close yet comfortable shave without necessarily requiring a need for a shaving cream or the like for preparing a skin surface that is to be shaved.

Unfortunately, these powered shaving devices with reciprocating razor heads suffer from a number of disadvantages that limit their usefulness. For example, powered shaving devices of necessity are larger and more awkward in use than non-powered or self-powered shaving devices. Furthermore, battery powered reciprocating razor head shavers tend to be heavier due to the weight of the contained battery. Still further, the batteries contained in such devices inevitably are exhausted such that they must be periodically changed or charged to maintain adequate power. Still another disadvantage is that such devices are considerably more expensive to purchase and operate than other non-powered or self-powered razors.

Certainly, a self-powered razor head presenting a solution to at least one of the problems left by the prior art would be useful. However, it is even more clear that a self-powered razor head that solves all of the problems from which the prior art has suffered while providing a number of heretofore unrealized advantages would represent a marked advance in the art.

SUMMARY OF THE INVENTION

Advantageously, a principal object of the present invention is to provide a razor head with at least one reciprocating razor blade that is self powered whereby a need for an external power source is eliminated. A further object of the invention is to provide such a self-powered razor head that is light in weight. Another object of the invention is to provide such a razor head that shaves hair from a skin surface effectively yet comfortably by a reciprocating razor action that not only shears but also slices hairs from the skin surface. Still another object of the invention is to provide a razor head with at least one reciprocating razor blade that is inexpensive in manufacture whereby the availability of the invention's benefits is increased. Undoubtedly, these and further objects and advantages of the present invention for a razor head will be obvious both to one who reviews the present specification and drawings and to one who has the opportunity to take advantage of the invention.

In accomplishing the aforementioned objects, one embodiment of the present invention for a self-powered razor head for shaving hair from a skin surface with at least one reciprocating blade essentially begins with a support case that rotatably supports a roller. The roller has an annular skin engaging surface and a plurality of ridges and troughs disposed on at least a first end thereof Of course, the plurality of ridges and troughs ideally are evenly spaced. The support case also reciprocatably supports a first razor shuttle. The razor head further includes a means for fixing a first razor blade to the first razor shuttle for movement therewith. A first drive arm has a first end coupled to the razor shuttle and a second end disposed adjacent to the plurality of ridges and troughs of the first end of the roller. Naturally, the razor head preferably will be supported by a razor handle.

Even with this most basic arrangement, a majority of the objectives of the invention are accomplished. In use, a movement of the skin engaging surface of the roller over a skin surface will induce a rotation of the roller, the rotation of the roller will induce lateral movement of the first drive arm over the plurality of ridges and troughs of the first end of the roller, and the lateral movement of the first drive arm will induce a reciprocation of the razor shuttle with a consequent reciprocation of a first razor blade that is fixed to the razor shuttle.

Ideally, however, the self-powered razor head will further include a means for biasing the second end of the first drive arm to travel against the plurality of ridges and troughs of the first end of the roller. Certainly, this biasing means may comprise a resilient biasing member such as a spring or any of its well-known equivalents. However, what may be considered a preferable biasing means may comprise a plurality of ridges and troughs disposed on a second end of the roller and a second drive arm with a first end coupled to the razor shuttle and a second end disposed adjacent to the plurality of ridges and troughs of the second end of the roller.

Preferably, the ridges and troughs and the first and second drive arms are arranged such that the drive arms engage their respective ridges and troughs oppositely in phase whereby when the second end of the first drive arm is disposed adjacent to a ridge of the first end of the roller the second end of the second drive arm will be disposed adjacent to a trough of the second end of the roller and when the second end of the first drive arm is disposed adjacent to a trough of the first end of the roller the second end of the second drive arm will be disposed adjacent to a ridge of the second end of the roller. This may be accomplished by, for example, disposing the ridges and troughs oppositely in phase at the ends of the roller or merely by relatively displacing the first drive arm relative to the second drive arm to engage the ridges and troughs of the ends of the roller oppositely in phase.

The invention is further improved by additionally including a second razor shuttle reciprocatably supported by the support case along with a means for fixing a second razor blade to the second razor shuttle and a means for inducing a reciprocation of the second razor shuttle in response to a reciprocation of the first razor shuttle. Although a plurality of means for inducing a reciprocation of the second razor shuttle in response to the reciprocation of the first razor shuttle are possible, one uniquely advantageous means comprises a drive lever with a first end pivotally coupled to the first razor shuttle, a second end pivotally coupled to the second razor shuttle, and a fulcrum point between the first end and the second end of the drive lever. Of course, the ends of the drive lever can be pivotally coupled to the razor shuttles in a variety of ways as by friction, restrictive shoulders, or even by forming the drive lever and the razor shuttles as a unit with a flexible connection between the ends of the drive lever and the razor shuttles. As a side note, it should be made clear that it is conceivable that the first and second razor blades could themselves comprise the first and second razor shuttles.

With this, when the first razor shuttle is moved in a first direction by the action of the drive arms moving over the ridges and troughs of the roller, the first end of the drive lever also will move in the first direction, and the drive lever will pivot about its fulcrum point. As a result, the second end of the drive lever will move in a second direction, which is opposite the first direction, and will drive the second razor shuttle in that second direction. As the drive arms move further over the ridges and troughs of the roller, the first razor shuttle will reach the extent of its travel and will change directions to move in the second direction, which will by the abovedescribed mechanism cause the second razor shuttle to travel in the first direction. This procedure will be repeated for each ridge-and-trough cycle, and its frequency will be varied by the wavelength of the ridges and troughs and the speed with which the roller is rotated.

One skilled in the art will realize that the foregoing discussion broadly outlines the more important features of the invention to enable a better understanding of the detailed description that follows and to instill a better appreciation of the inventor's contribution to the art. Before an embodiment of the invention is explained in detail, it must be clear that the following details of construction, descriptions of geometry, and illustrations of inventive concepts are mere examples of possible manifestations of the invention.

DETAILED DESCRIPTION OF PREFERRED EMBODIMENTS

As with many inventions, the broad nature of the present invention can lend itself to many different forms. However, to enable the proper practice and understanding of the significance of the present invention by those who learn from the present disclosure, the detailed description that follows will set forth the embodiments presently found most preferable for practicing the present invention for a self-powered razor head.

Figure 1:
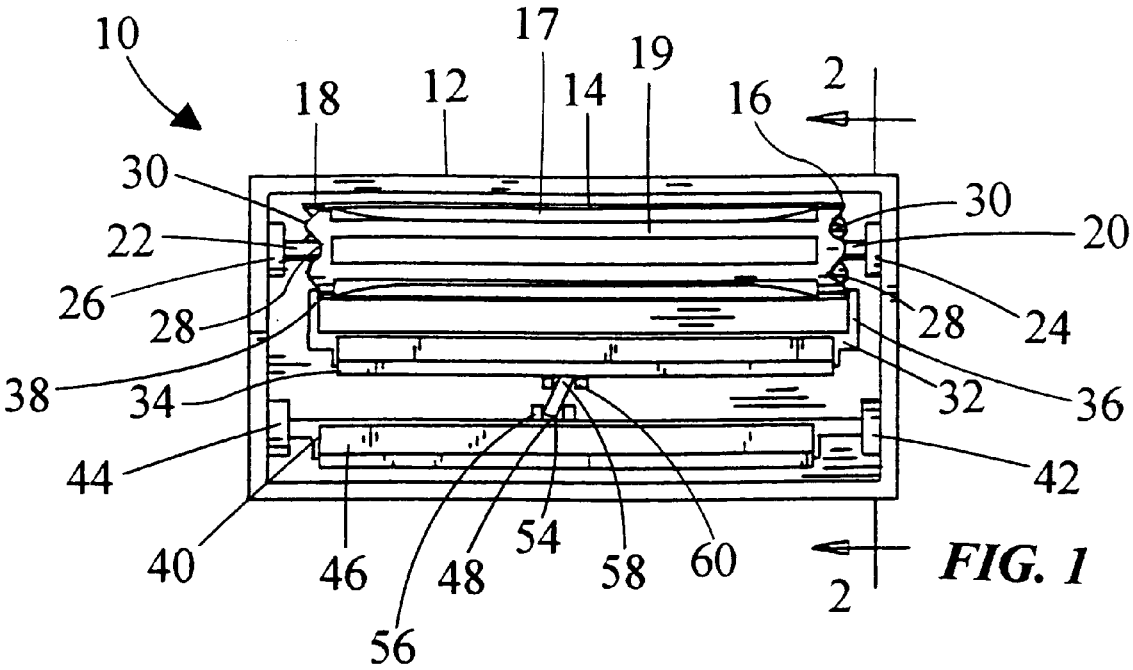
FIG. 1 is a top plan view of a self-powered razor head according to the present invention.
Figure 2:
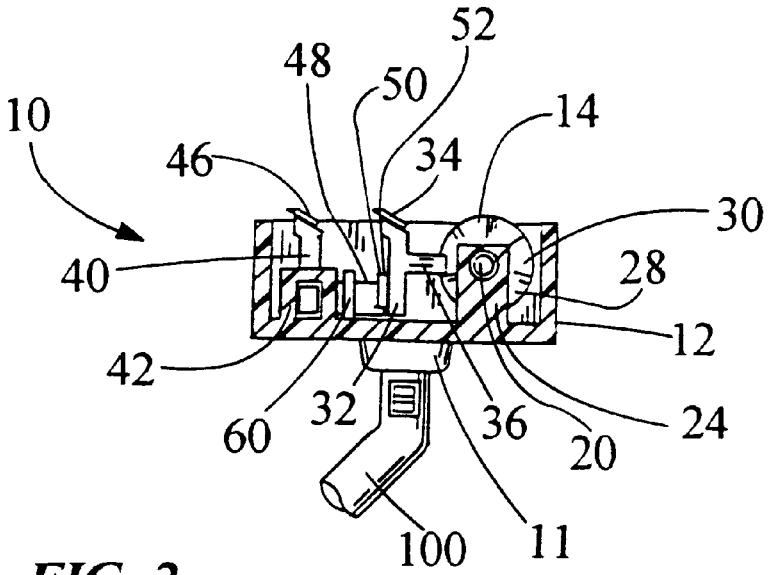
FIG. 2 is a cross-sectional view of the present invention for a self-powered razor head taken along the line 2—2 in FIG. 1.

Looking more particularly to the drawings, a presently preferred embodiment of the invention for a self-powered razor head is indicated generally at 10 in each figure. Turning first to FIG. 1, which is a top plan view of the self-powered razor head 10, and FIG. 2, which is a cross-sectional view of the razor head 10 of FIG. 1 taken along the line 2—2, one sees that the razor head 10 is founded upon a support case 12. FIG. 2 shows that the support case 12 is coupled to a razor handle 100 by a suitable coupling means II to enable the razor head 10 to be manipulated most effectively during shaving.

In FIGS. 1 and 2, it is shown that the support case 12 retains a roller 14, which has a first end 16, a second end 18, and an annular skin engaging surface 17. To improve traction as the roller 14 is rolled over a skin surface of a user (not shown), the annular skin engaging surface 17 comprises a plurality of longitudinally-communicating crests 19 that are textured. The roller 14 has first and second axis rods 20 and 22 projecting from its first and second ends into first and second alcoves 24 and 26 formed within the support casing 12. Together, the first and second alcoves 24 and 26 rotatably retain the roller 14 within the support case 12. Each of the first and second ends 16 and 18 of the roller 14 has a plurality of ridges 28 and troughs 30 evenly disposed thereon. It is important to note that the plurality of ridges 28 and troughs 30 of the first end 16 of the roller 14 are disposed approximately oppositely in phase relative to the plurality of ridges 28 and troughs 30 of the second end 18 of the roller 14, A first razor shuttle 32 is reciprocatably supported by the support case 12. A first razor blade 34 is fixed to the first razor shuttle 32 for reciprocating movement therewith. As FIG. 2 shows most clearly, the first razor blade 34 is angularly disposed relative to the support case 12. A first drive arm 36 and a second drive arm 38 each project from the first razor shuttle 32 and are disposed to ride against the oppositely-phased ridges 28 and troughs 30 of the first and second ends 16 and 18 of the roller 14 respectively. With the first and second drive arms 36 and 38 so disposed, a rotation of the roller, such as when it is rolled over a skin surface that is to be shaved, will induce the first and second drive arms 36 and 38 to follow the ridge-and-trough profiles of the first and second ends 16 and 18 of the roller. This following action will lead to a reciprocation of the first and second drive arms 36 and 38 which in turn will induce a reciprocation of the first razor shuttle 32 and the first razor blade 34 that is fixed thereto.

Although the foregoing elements certainly represent a useful razor head 10 device, the invention is improved still further by the inclusion of a second razor shuttle 40 that is reciprocatably retained within the support case 12 by first and second alcoves 42 and 44. A second razor blade 46 is fixed to the second razor shuttle 40 for movement therewith.

As FIG. 2 shows most clearly, the second razor blade 46 is angularly disposed relative to the support case 12. The invention's unique means for inducing a reciprocation of the second razor shuttle 40 in response to a reciprocation of the first razor shuttle 32 in this embodiment comprises a drive lever 48 that has a first end 50 pivotally coupled to the first razor shuttle 32 by a pair of restrictive shoulders 52, a second end 54 pivotally coupled to the second razor shuttle 40 by a pair of restrictive shoulders 56, and a fulcrum point 58 created by a pair of fulcrum rods 60.

Although it is not shown, it may be found most preferable in practice to include a lid for the support case 12 to conceal, protect, and possibly restrain the inner workings of the razor head 10. Furthermore, it should be noted that the razor head 10 may be constructed such that the first and second razor blades 34 and 46 are readily replaceable to account for wear. With this, the useful life of each razor head 10 could be readily extended by a replacement of the first and second razor blades 34 and 46. Still further, one must recognize that the aforedescribed elements certainly could be constructed from a wide variety of materials, but one might suppose that the majority of the razor head could be molded from a plastic or its equivalent while the first and second razor blades 34 and 46 would likely be formed most advantageously from a properly chosen metal alloy.

In any event, under the described arrangement, when a user draws the razor head 10 over a skin surface that is to be shaved, the first razor shuttle 32 is moved in a first direction by the action of the drive arms 36 and 38 moving over the ridges and troughs 28 and 30 of the roller 14, the first end 50 of the drive lever 48 also will move in the first direction, and the drive lever 48 will pivot about its fulcrum point 58. As a result, the second end 54 of the drive lever 48 will move in a second direction, which is opposite the first direction, and will drive the second razor shuttle 40 in that second direction. As the drive arms 36 and 38 move further over the ridges and troughs 28 and 30 of the roller 14, the first razor shuttle 32 will reach the extent of its travel and will change directions to move in the second direction, which will by the abovedescribed mechanism cause the second razor shuttle 40 to travel in the first direction.

This procedure will be repeated for each ridge-and-trough cycle, and its frequency will be varied by the wavelength of the ridges and troughs 28 and 30 and the speed with which the roller 14 is rotated. With this, a user will enjoy a unique shaving mechanism wherein hair will be sheared and sliced from the chosen skin surface by the combined effects of the reciprocating first and second razor blades 34 and 46. It is worth noting here that the inventor theorizes that the unique reciprocating action of the first and second razor shuttles 32 and 40 may allow the present invention to be used without shaving cream or its equivalent as is required with prior art non-powered or self-powered razors.

Figure 3:
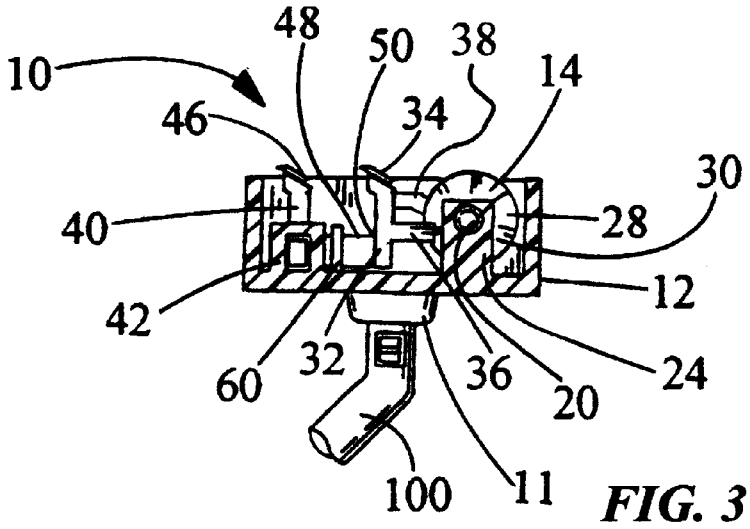
FIG. 3 is a cross-sectional view of an alternative embodiment of the present invention for a self-powered razor head.

An alternative embodiment of the invention for a self-powered razor head 10 is shown in cross section in FIG. 3. This embodiment of the invention is similar in most respects to the embodiment shown in FIGS. 1 and 2 except for the disposition of the first and second drive arms 36 and 38, the disposition of the ridges 28 and troughs 30 on the first and second ends 16 and 18 of the roller 14, and the means for pivotally coupling the first and second ends 50 and 54 of the drive lever 48 to the first and second razor shuttles 32 and 40 respectively. Stated more particularly, the opposite phase relationship of the first and second drive arms 36 and 38 relative to the ridges 28 and troughs 30 of the first and second ends 16 and 18 of the roller 14 is accomplished not by manipulation of the relationship between the ridges 28 and troughs 30 of the first and second ends 16 and 18 of the roller 14 but instead by disposing the first and second drive arms 36 and 38 to ride oppositely in phase against the ridges 28 and troughs 30, which then may be identically disposed. A further difference found in this embodiment is that the pivotal coupling of the first and second ends 50 and 54 of the drive lever 48 to the first and second razor shuttles 32 and 40 respectively is accomplished by a frictional coupling, and the pairs of restrictive shoulders 52 and 56 are obviated.

Figure 4:
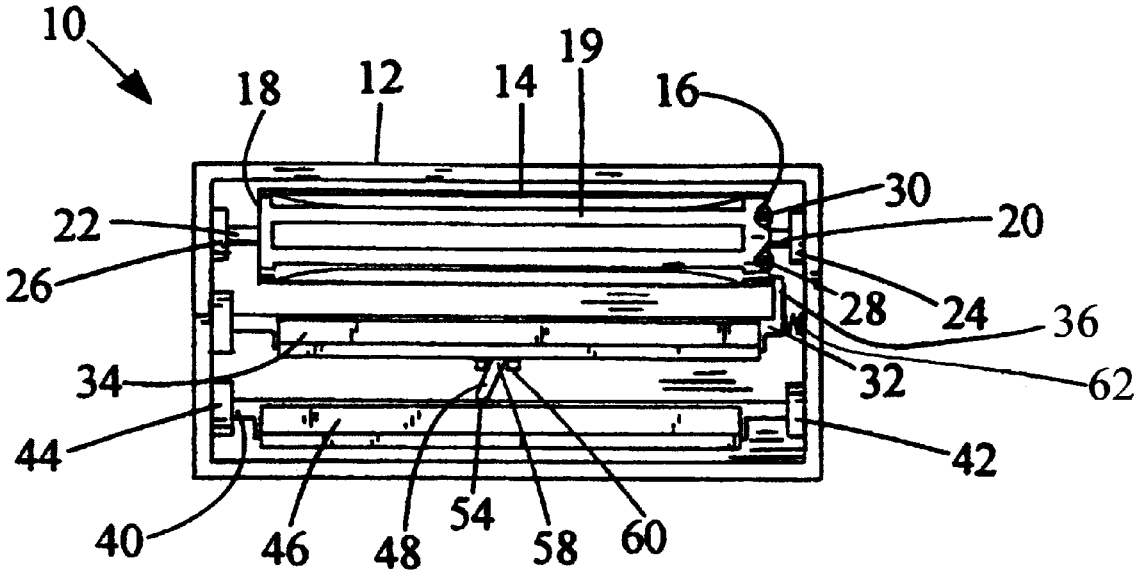
FIG. 4 is a top plan view of another alternative embodiment of the present invention.

A still further embodiment of the invention is shown in FIG. 4. This embodiment also is similar in most respects to the previous embodiments of the invention except with regard to two unique modifications. The first is that this embodiment employs a resilient biasing member 62, which in this case is a spring 62, as its means for biasing the distal end of the first drive arm 36 to travel against the plurality of ridges 28 and troughs 30 of the first end 16 of the roller 14. With this, the second drive arm 38 and the plurality of ridges 28 and troughs 30 at the second end 18 of the roller 14 are obviated. Of course, one skilled in the art will realize that the spring 62 is just one example of a multiplicity of equivalent means for biasing the distal end of the first drive arm 36 to travel against the plurality of ridges 28 and troughs 30 of the first end 16 of the roller 14.

The second noteworthy difference found in the embodiment of the invention shown in FIG. 4 relates to the means for pivotally coupling the first and second ends 50 and 54 of the drive lever 48 to the first and second razor shuttles 32 and 40 respectively. In this embodiment, the pivotal coupling is accomplished by forming the first and second razor shuttles 32 and 40 unitarily with the drive lever 48 with an appropriately flexible, pivotable coupling between the first and second ends 50 and 54 of the drive lever 48 to the first and second razor shuttles 32 and 40 respectively. Certainly one skilled in the art will readily be aware of a plurality of means for so forming the drive lever 48 and the first and second razor shuttles 32 and 40. One might suppose that a most preferable means of creating such a pivotal coupling would be by forming these elements from a tough but flexible plastic or its equivalent.

From the foregoing, it will be apparent that the present invention for a self-powered razor head 10 provides a plurality of advantages to one who has the opportunity to take advantage of it in shaving hair from a skin surface. Among the most basic of these advantages is that the invention provides a razor head 10 that simultaneously shears and slices hair from a skin surface by a combined raking and reciprocating action of the first and second razor blades 34 and 46 as they are drawn across a skin surface and driven by the unique self-powered motor action resulting from the combined actions of the roller 14, the first and second drive arms 36 and 38, the drive lever 48, and the first and second razor shuttles 32 and 40. With this, it is seen that a user can enjoy a uniquely effective shave with dual first and second reciprocating razor blades 34 and 46 without need for a razor with an external power source. It also becomes clear that the present invention provides a self-powered razor head 10 that is light in weight and relatively inexpensive in manufacture whereby the availability of the invention's benefits is increased. Of course, it should again be stated these and further objects and advantages of the present invention will be obvious both to one who reviews the present specification and drawings and to one who has the opportunity to take advantage of the invention.

Furthermore, although the invention has been shown and described with reference to certain preferred embodiments, those skilled in the art undoubtedly will find alternative embodiments obvious after reading this disclosure. With this in mind, the following claims are intended to define the scope of protection to be afforded to the present inventor, and those claims shall be deemed to include equivalent constructions insofar as they do not depart from the spirit and scope of this invention.

What is claimed is:

1. A self-powered razor head for shaving hair from a skin surface with at least two reciprocating blades, the razor head comprising:

a support case;

a roller rotatably supported by the support case, the roller with a first end, a second end, and an annular skin engaging surface for engaging a skin surface;

a means for reciprocatably supporting a first razor blade relative to the support case;

a means for inducing a reciprocation of the first razor blade in response to a rotation of the roller;

a means for reciprocatably supporting a second razor blade relative to the support case; and a means for inducing a reciprocation of the second razor blade in response to the reciprocation of the first razor blade;

whereby a movement of the skin engaging surface of the roller over a skin surface will induce a rotation of the roller, the rotation of the roller will induce a reciprocation of the first razor blade, and the reciprocation of the first razor blade will induce a reciprocation of the second razor blade.

2. The razor head of claim 1 wherein the means for reciprocatably supporting the first razor blade relative to the support case comprises a first razor shuttle reciprocatably supported by the support case and wherein the means for reciprocatably supporting the second razor blade relative to the support case comprises a second razor shuttle reciprocatably supported by the support case.

3. The razor head of claim 1 wherein the means for inducing a reciprocation of the second razor blade in response to the reciprocation of the first razor blade comprises a drive lever with a first end pivotally coupled to the means for reciprocatably supporting the first razor blade, a second end pivotally couplable to the means for reciprocatably supporting the second razor blade, and a fulcrum point between the first end and the second end of the drive lever.

4. A self-powered razor head for shaving hair from a skin surface with at least one reciprocating blade, the razor head comprising:

a support case;

a roller rotatably supported by the support case wherein the roller has a first end, a second end, and an annular skin engaging surface;

a plurality of ridges and troughs disposed on at least the first end of the roller;

a means for reciprocatably supporting a first razor blade relative to the support case;

a means for retaining a second razor blade relative to the support case; and a first drive arm with a first end drivingly associated with the means for reciprocatably supporting the first razor blade and a second end disposed adjacent to the plurality of ridges and troughs ofthe first end of the roller;

whereby a movement of the skin engaging surface of the roller over a skin surface will induce a rotation of the roller, the rotation of the roller will induce lateral movement of the first drive arm over the plurality of ridges and troughs of the first end of the roller, and the lateral movement of the first drive arm will induce a reciprocation of the means for reciprocatably supporting the first razor blade.

5. The razor head of claim 4 wherein the means for reciprocatably supporting the first razor blade relative to the support case comprises a first razor shuttle reciprocatably supported by the support case.

6. The razor head of claim 4 wherein the plurality of ridges and troughs disposed on the first end of the roller are evenly spaced.

7. The razor head of claim 4 further comprising a means for biasing the second end of the first drive arm to travel against the plurality of ridges and troughs of the first end of the roller.

8. The razor head of claim 7 wherein the means for biasing the second end of the first drive arm to travel against the plurality of ridges and troughs of the first end of the roller comprises a plurality of ridges and troughs disposed on the second end of the roller and a second drive arm with a first end drivingly associated with the means for reciprocatably supporting the first razor blade and with a second end disposed adjacent to the plurality of ridges and troughs of the second end of the roller.

9. The razor head of claim 8 wherein the plurality of ridges and troughs of the first end of the roller and the plurality of ridges and troughs of the second end of the roller are approximately opposite in phase whereby, when the second end of the first drive arm is disposed adjacent to a ridge of the first end of the roller, the second end of the second drive arm will be disposed adjacent to a trough of the second end of the roller and, when the second end of the first drive arm is disposed adjacent to a trough of the first end of the roller, the second end of the second drive arm will be disposed adjacent to a ridge of the second end of the roller.

10. The razor head of claim 8 wherein the second end of the first drive arm and the second end of the second drive arm are disposed to engage the ridges and troughs of the first and second ends of the roller approximately oppositely in phase whereby, when the second end of the first drive arm is disposed adjacent to a ridge of the first end of the roller, the second end of the second drive arm will be disposed adjacent to a trough of the second end of the roller and, when the second end of the first drive arm is disposed adjacent to a trough of the first end of the roller, the second end of the second drive arm will be disposed adjacent to a ridge of the second end of the roller.

11. The razor head of claim 7 wherein the means for biasing the second end of the first drive arm to travel against the plurality of ridges and troughs of the first end of the roller comprises a resilient biasing member.

12. The razor head of claim 4 further comprising a handle coupled to the support case.

13. The razor head of claim 4 wherein the means for retaining the second razor blade relative to the support case comprises a means for reciprocatably retaining the second razor blade relative to the support case and wherein the razor head further comprises a means for inducing a reciprocation of the second razor blade in response to a reciprocation of the first razor blade.

14. The razor head of claim 13 wherein the means for reciprocatably retaining the second razor blade relative to the support case comprises a second razor shuttle reciprocatably retained by the support case.

15. The razor head of claim 13 wherein the means for inducing a reciprocation of the second razor blade in response to a reciprocation of the first razor blade comprises a drive lever with a first end pivotally coupled to the first razor blade, a second end pivotally coupled to the second razor blade, and a fulcrum point between the first end and the second end of the drive lever.

16. The razor head of claim 15 wherein at least one end of the drive lever is pivotally coupled to one of the first and second razor blades by a frictional coupling.

17. The razor head of claim 15 wherein at least one end of the drive lever is pivotally coupled to one of the first and second razor blades by restrictive shoulders.

18. The razor head of claim 15 wherein at least one end of the drive lever is pivotally coupled to one of the first and second razor blades by a unitary formation of that end of the drive lever and that one of the first and second razor blades.

* * * * *